US006279975B1

(12) United States Patent
Gamliel

(10) Patent No.: US 6,279,975 B1
(45) Date of Patent: Aug. 28, 2001

(54) IMPLEMENT AND METHOD FOR PICKING UP AND REMOVING PET EXCREMENT

(76) Inventor: Shai Gamliel, 56 Brener St., Herzliya, 46427 (IL)

( * ) Notice: Subject to any disclaimer, the term of this patent is extended or adjusted under 35 U.S.C. 154(b) by 0 days.

(21) Appl. No.: 09/622,088

(22) PCT Filed: Feb. 4, 1999

(86) PCT No.: PCT/IL99/00074

§ 371 Date: Sep. 11, 2000

§ 102(e) Date: Sep. 11, 2000

(87) PCT Pub. No.: WO99/40779

PCT Pub. Date: Aug. 19, 1999

(30) Foreign Application Priority Data

Feb. 12, 1998 (IL) ..... 123272

(51) Int. Cl.[7] ..... A01K 29/00; B65B 67/12

(52) U.S. Cl. ..... 294/1.3; 294/1.4; 15/257.1

(58) Field of Search ..... 294/1.1, 1.3–1.5, 294/55; 15/257.1, 257.6, 257.7, 257.9, 104.8; 248/95, 99, 100, 101

(56) References Cited

U.S. PATENT DOCUMENTS 4,341,410 7/1982 Summach .
4,466,647 8/1984 Spevak .
4,723,803 2/1988 Sapp .
5,615,853 4/1997 Hearst .
5,857,722 1/1999 Ayotte .

FOREIGN PATENT DOCUMENTS 2683139 5/1993 (FR) .

*Primary Examiner*—Dean J. Kramer
(74) *Attorney, Agent, or Firm*—Shalom Wertsberger; Saltamar Innovations

(57) ABSTRACT

An implement for picking up and removing pet excrement from a surface, comprising a string element, a disposable flexible sheet that my be coupled to the string element, so as to form an edge of the sheet led by the string element, the sheet being removable from the implement, and an isolation mechanism for isolating the pet excrement from the surface by way of sliding the sheet between the pet excrement and the surface while maintaining the string element in a tautly stretched configuration so long as the string element is in close contact with the surface, the isolation mechanism comprising a grip for gripping and moving the isolation mechanism by the hand of the user.

34 Claims, 9 Drawing Sheets

IMPLEMENT AND METHOD FOR PICKING UP AND REMOVING PET EXCREMENT

TECHNICAL FIELD

The present invention concerns portable devices for picking up, collecting and removing or disposing of droppings of a pet animal such as a dog or the like, and more particularly to a dropping picking up and removing implement and method adapted to collect pet excrement from the ground in a neat and convenient way without contaminating the implement itself or the hands.

BACKGROUND ART

Disposal of feces of pets is an unpleasant task and a variety of gadgets in the prior art are aimed at handling, scrubbing, scooping up, grabbing, collecting, removing, disposing and even intercepting the extrata by some catching means before any dung is deposited on the ground. However, catching means are impractical with the often undisciplined pets. Scrubbing means and pooper scoopers pose the problem of keeping them uncontaminated. There is also the issue of collecting and carrying the waste and all of these problems need to be solved through the use of compact and portable means that may be comfortably used by a person mastering or escorting a pet animal in the street or a public place.

Therefore, objects of this invention are to provide a device for collecting pet ordure that meets the above mentioned requirements, that is compact, portable, adapted to collect and carry for disposal pet refuse from the ground—particularly flat surfaces such as the floor of a sidewalk, in a neat and convenient manner without contaminating the device itself, easy to use or to handle in a public place, non complex in construction and low in production costs.

These and other objectives are provided by the invention described below.

DISCLOSURE OF THE INVENTION

There is thus provided according to the present invention a novel implement for picking up and removing pet excrement from a surface, comprising a support member having two securing ends, a tension member removably stretched at two spaced apart points thereof to the two securing ends, and a disposable flexible sheet for isolating the pet excrement from the surface by sliding the sheet between the pet excrement and the surface, the sheet being permanently attached to the tension member at leading edge of the sheet, the sheet and the tension member being removable from the support member, wherein the securing ends provide for close contact of the tension member with the surface, while the implement is held by the hand of the user and moved about.

The sheet may be coupled to the tension member by thermal welding of the sheet to the tension member or adhering the sheet to the tension member, and the sheet may comprise a polymer, wherein the polymer is a thermoplastic material, or be self-clinging wrapping nylon sheet. The tension member may comprise a polymer, or a metallic wire, wherein the polymer is a thermoplastic material,. The sheet may be apportioned into detachable portions, each such portion comprises two plies, a first section of which plies comprises three connected edges to form a bag like section, the plies being disjoined at their second section to form a mouth section, wherein one ply of the two disjoined plies in the mouth section provides for its enfolding about the bag like section, and the other of the two disjoined plies is attached to the tension member.

According to one preferable embodiment, the support member comprises an arcuate member across the tips of which the tension member is removably stretched, and optionally a member comprises a handle portion coupled thereto, that may also be removable. The arcuate member may comprise a flexible elongated bar being substantially straight when in a non-operative mode, the bar providing for its bending by the user to form a bowed bar and so retained in its operative mode by means of attaching the tension member to the tips of the bowed bar, wherein the arcuate member in its operative mode continuously stretches the tension member when the tension member is attached to the arcuate member. The arcuate member may also comprise a flexible bowed bar, wherein the bar comprises a contraction handle extending from the inner side portion of the bar to the upper portion of the bar toward the intermediate portion of the bar, the handle being sized for its forcing by at least one finger of the user gripping the bar toward the upper portion of the bar, thereby temporarily contracting the bar by nearing the tips of the bar so long the handle is forced toward the bar.

Optionally, the arcuate member may also comprise at least one laterally protruding hook element mounted at each of its tips, the tension member comprises mating openings at its ends providing for the loose assembling of the tension member on the arcuate member, when the arcuate member is temporarily forced to contract, the arcuate member stretches the tension member so assembled, when the contraction ceases.

According to another embodiment, the support member comprises bipod like casing members across the free ends of which the tension member may be stretched, the casing members being hingedly connected to each other and to an elongated handle, the casing members and the elongated handle are collapsible to be aligned side by side in the stored position of the support member, the casing members extend to one direction and the elongated handle to the opposite direction when the support member is deployed in its operative mode, the casing members further comprise spacing means for keeping them apart when deployed in their operative mode.

Preferably, the tension member comprises two tabs at the ends thereof, the support member comprises mating notches at the securing ends, allowing removable snap-fit nesting of the tabs in the notches. Each tab may comprise a tapered portion attached to an end of the tension member, the tapered portion protruding downwardly from the support member and touching the surface when the implement is held in an operational position.

According to a further embodiment, the implement comprises the disposable flexible sheet, the grip means in the form of an elongated hollow tubular body having an apertured end being so sized to be comfortably held by a human hand, the tubular body being adapted for containing a roll of the sheet wherein an end of the sheet may be unrolled and drawn out through the apertured end, and a support member comprising two forwardly extending securing arms, coupled to the tubular body and along which the sheet may be expanded, the securing arms comprise spikes, which spikes being spaced apart at a distance corresponding to the width of the sheet, and a tension member stretched between distal ends of the securing arms at a distance from the spikes adequate for containing pet excrement, wherein a drawn out portion of the sheet may be pierced once at its sides by the spikes, stretched from the spikes to the tension member, folded about the tension member, stretched back toward the spikes and pierced again by the spikes to form a two ply extension of the sheet stretched between the spikes and the tension member, and wherein the securing arms provide for close contact of the tension member with the surface, while the implement is held by the hand of the user, and moved about.

Preferably, the support member comprises two forwardly extending securing arms, the securing arms being distanced from each other at a distance corresponding to the width of the sheet, the spikes being mounted in registration on the securing arms adjacent to the apertured end of the tubular body and the tension member being stretched between the free ends of the securing arms. The support member may comprise a rigid strap curving around the tubular body so as to snugly engage the tubular body in a friction tight engagement, and wherein the securing arms are firmly attached to the strap.

The apertured end of the tubular body may also comprise a lid having a threaded sleeve adapted to its screwing in a mating threaded end portion of the tubular body, the lid further comprises a centrally apertured extension through which the sheet may be passed in a contracted manner, the extension being externally threaded and adapted to its partial or full closure by an internally threaded compatible cap member.

The spikes preferably comprise a pair of cone shaped spikes having their base mounted on the securing arms, correspondingly and a groove is cut around each of the spikes at a distance from its peak. The spikes may comprise two pairs of spikes, wherein one pair protrudes upwards and the other pair protrudes downwards.

In a further embodiment of the invention, the tension member comprises a strip, that may also comprise a toughened material, wherein the strip comprises a longitudinally non-elastic and transversely flexible material.

In a yet another embodiment, the implement comprises the support member, a tension strip removably stretched at two spaced apart points thereof, to the two securing ends, and the disposable flexible sheet, wherein the securing ends provide for close contact of the tension strip with the surface, while the implement is held by the hand of the user, and moved about, and wherein the tension strip is permanently attached to the sheet, the tension strip comprises a longitudinal non-elastic and transversely flexible material, and the tension strip comprises a toughened material.

The invention also features a method for picking up and removing pet excrement from a surface, comprising the steps of providing a flexible sheet, permanently coupling the sheet to a stretched tension member so as to form a leading edge of the sheet, moving the tension member with the sheet coupled thereto toward the excrement to be picked up, while keeping the tension member in close contact with the surface, slipping the sheet between the excrement and the surface by moving the tension member between the pet excrement and the surface, so as to isolate the excrement from the surface by the sheet in there between, wrapping the excrement by the sheet; and removing the sheet wrapping the excrement and disposing thereof.

The invention features yet another method for picking up and removing pet excrement from a surface, comprising the steps of providing the sheet, coupling the sheet to a stretched tension strip so as to form a leading edge of the sheet, moving the tension strip with the sheet coupled thereto toward the excrement to be picked up, while keeping the tension strip in close contact with the surface, slipping the sheet between the pet excrement and the surface, so as to isolate the excrement from the surface, by the sheet there between, wrapping the excrement by the sheet, and removing the sheet wrapping the excrement and disposing thereof.

Further features and advantages of the invention will be apparent from the description below, given by way of example only.

BRIEF DESCRIPTION OF THE DRAWINGS

The present invention will be further understood and appreciated from the following detailed description, taken in conjunction with the following enclosed drawings inwhich like reference numerals designate correspondingly analogous elements or sections throughout, and in which.

BEST MODES FOR CARRYING OUT THE INVENTION

Figure 1:
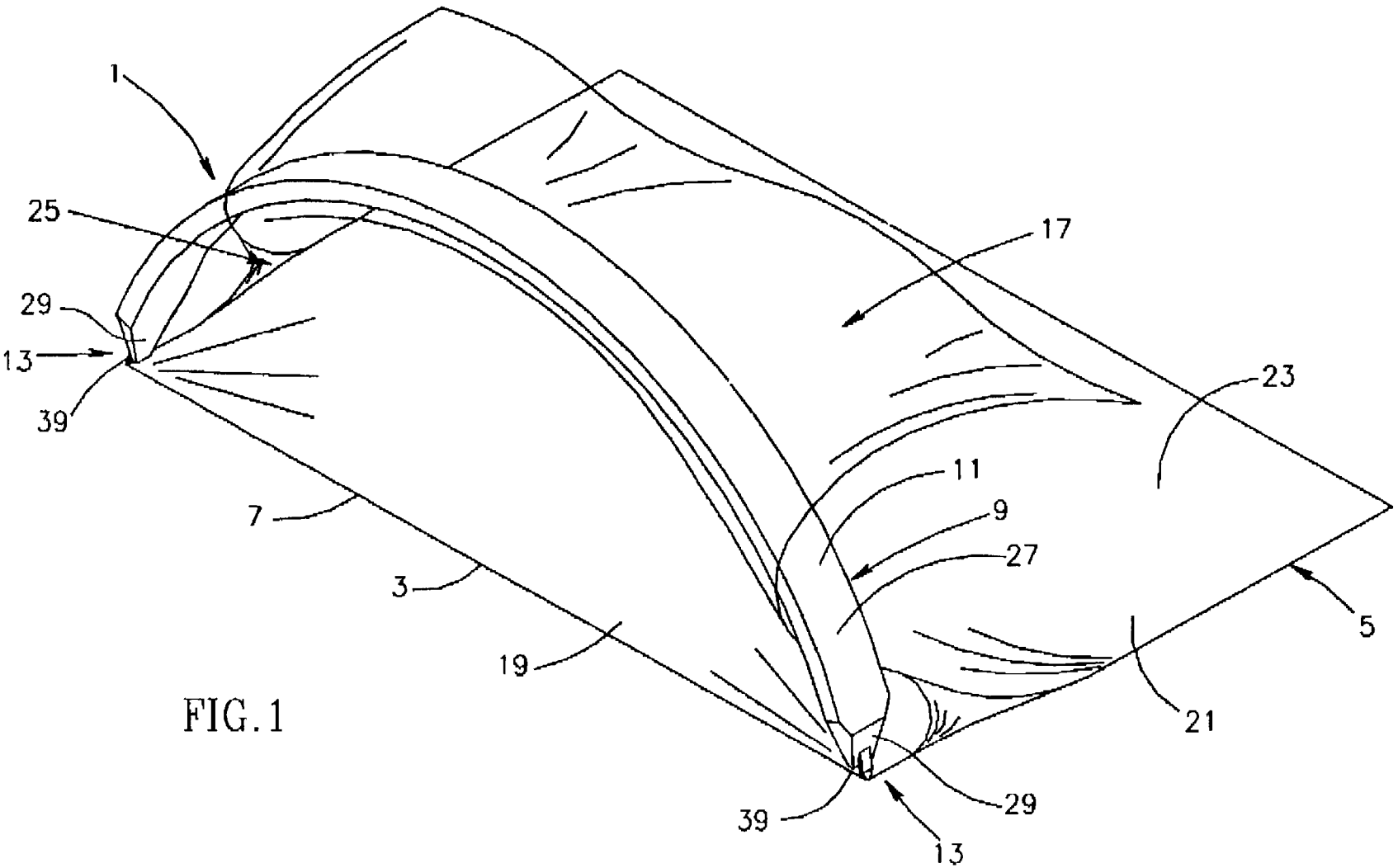
FIG. 1 is a perspective view of one embodiment constructed and operative in accordance with the invention.
Figure 2:
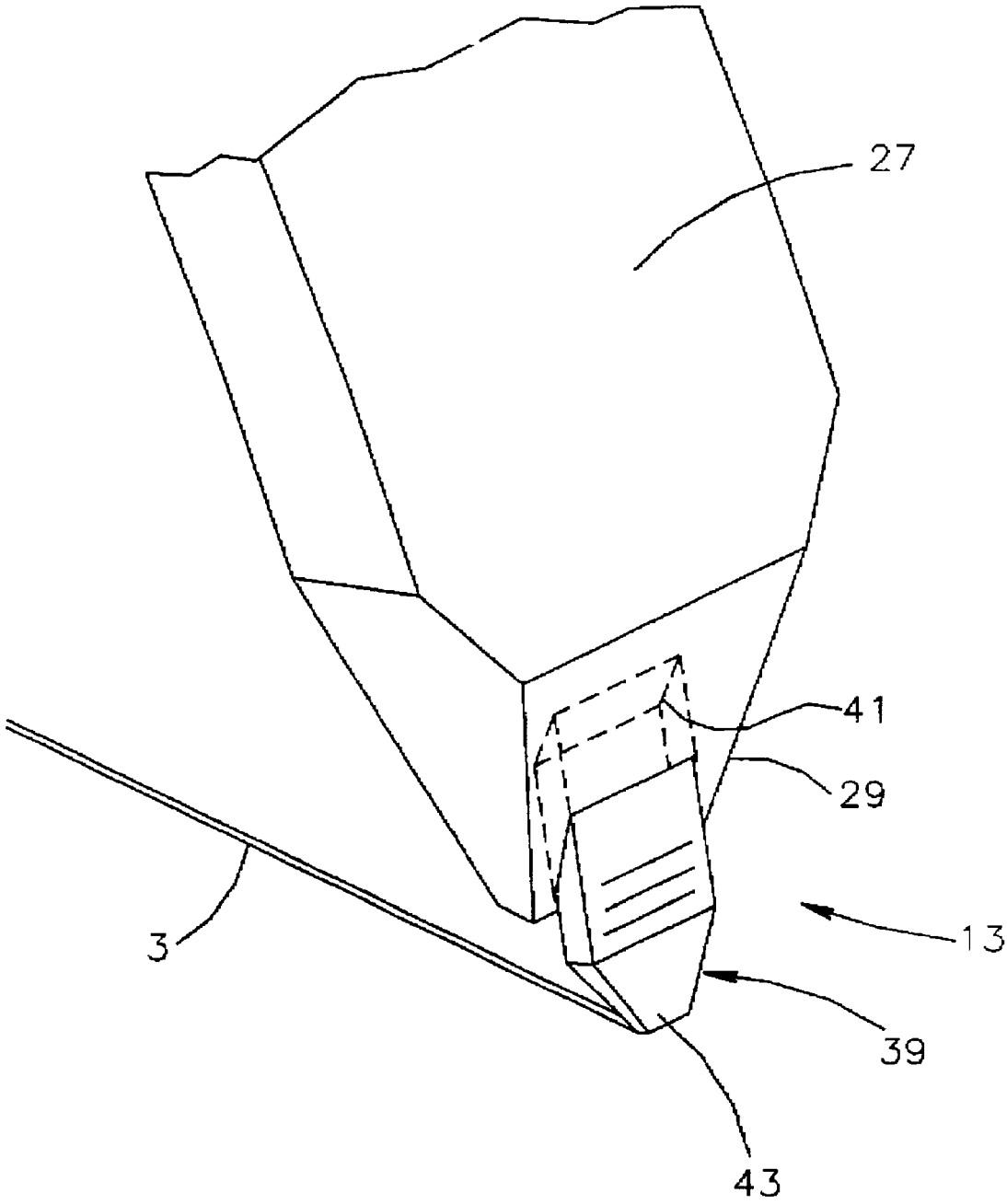
FIG. 2 is an enlarged sectional view of the connection between the arcuate support member and the tension member of the embodiment of FIG. 1.
Figures 3, 4:
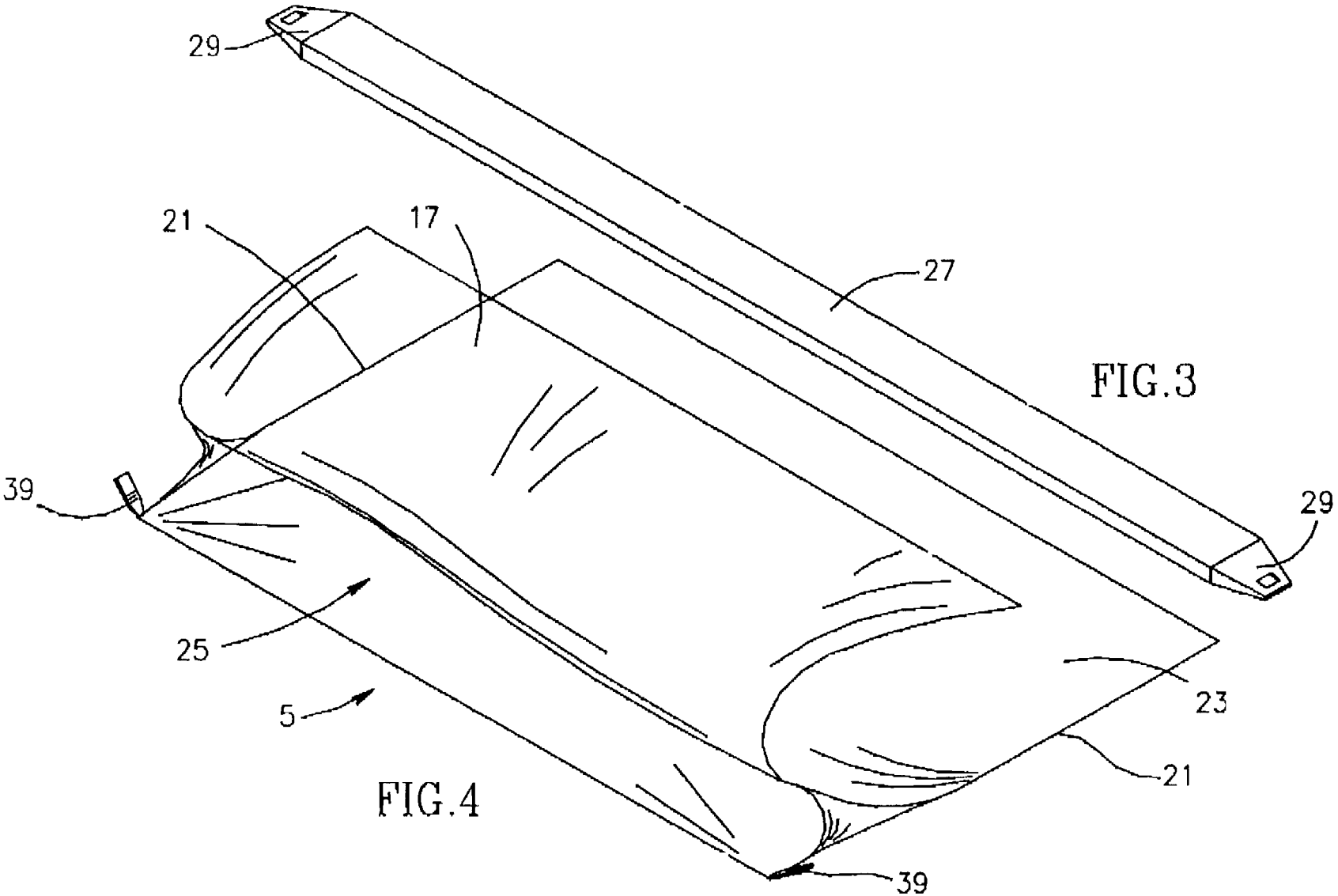
FIG. 3 is a perspective view of the arcuate support member of the embodiment of FIG. 1 in a straight unbent configuration.
FIG. 4 is a view of a two ply sheet that may be used in conjunction with the embodiment of FIG. 1.
Figure 5:
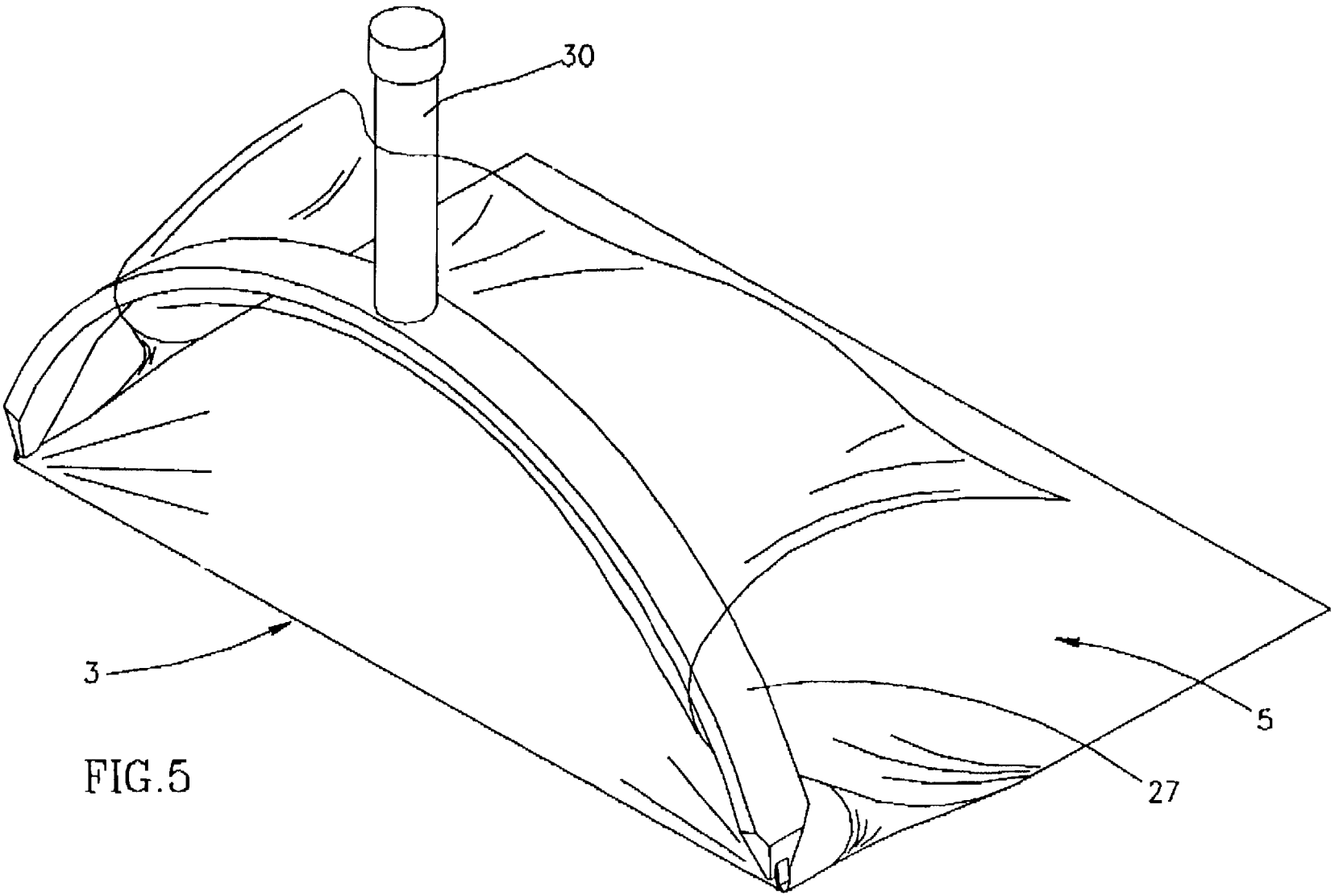
FIG. 5 is a schematic view of an optional handle that may be added to the embodiment of FIG. 1.

Referring to the embodiment shown in FIGS. 1–4, there is provided an implement 1 for picking up and removing pet excrement from a surface. Implement 1 is primarily aimed at cleaning flat surfaces, which are the common public ground in which removal of pet feces mostly needed and in which avoidance of such removal is embarrassing or even illegal. Implement 1 comprises a tension member 3 to which a disposable flexible sheet 5 may be coupled so as to form an edge 7 of sheet 5 that is led by tension member 3. It will be appreciated that the term "tension member" refers to any member that functions in a similar way, such as bands, ribbons, straps, strips and the like. Sheet 5 is preferably removable from implement 1 in order to provide easy and neat disposal thereof when sheet 5 is soiled with pet refuse, without defiling other components of implement 1 or the user hands. The combination of sheet 5 and tension member 3 allows isolation of the pet excrement from a surface. An example of such an isolation is shown in FIGS. 1–4. Such an isolation is provided by grip means 11 for gripping and moving implement 1 by the hand of the user, and slip means 13 for slipping or sliding sheet 5 between the pet excrement and the surface to be cleaned. To this aim, string 3 is maintained by slip means 13 in a tautly stretched configuration while tension member 3 is in close contact with the surface, and wherein slip means 13 may be moved by grip means 11 while keeping tension member 3 in close contact with the surface. It is clearly apparent that tension member 3—due to its inherent thinness—will easily lead sheet 5 below the excrement to be removed, so long as tension member 3 is kept stretched and proximate to the surface and is pushed or pulled from its sides through the area in which the excrement is positioned on the surface.

Figure 10:
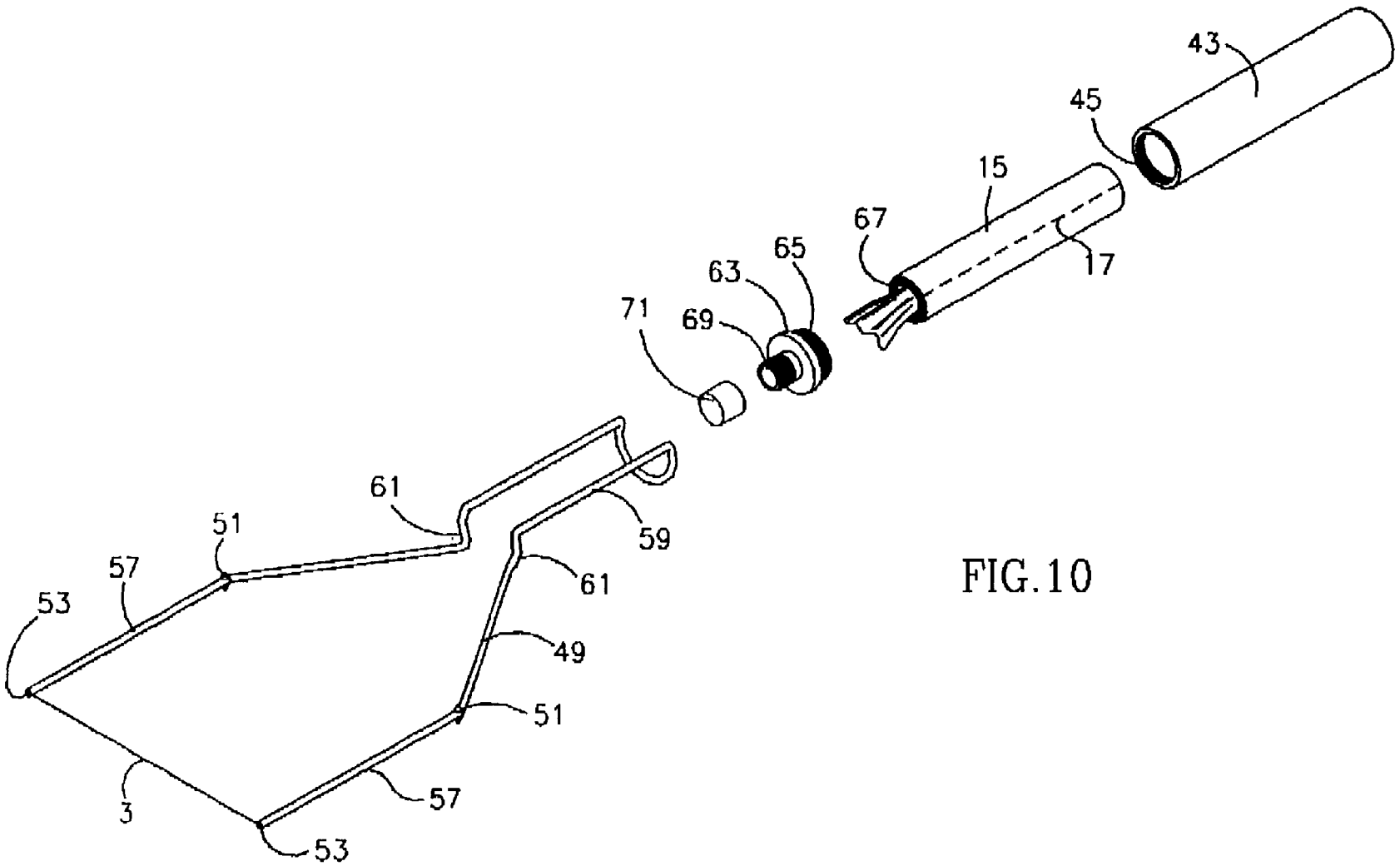
FIG. 10 is a schematic perspective exploded view of a the embodiment of FIG. 8 showing its different elements.
Figure 11:
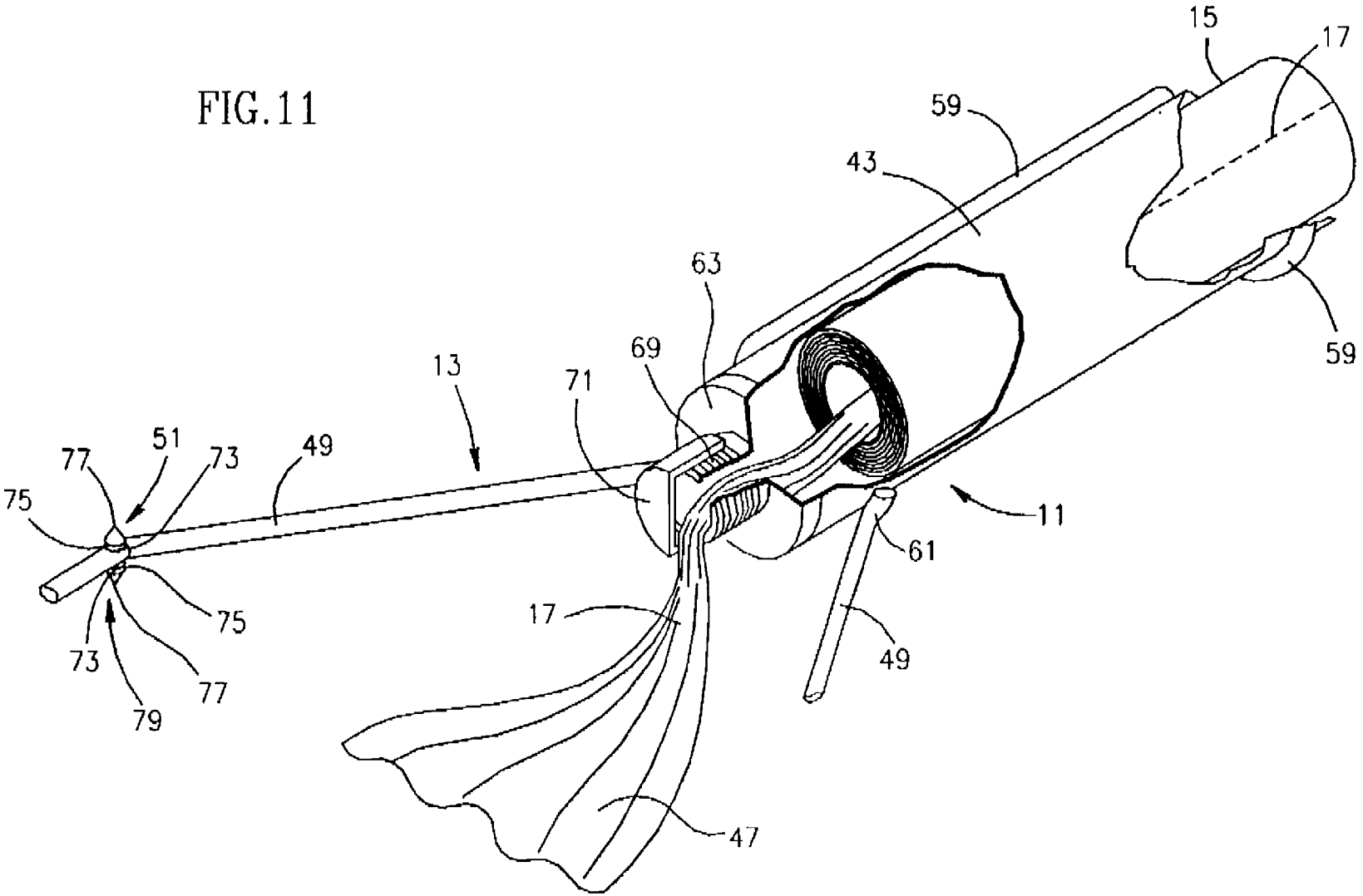
FIG. 11 is a partially cut out enlarged partial view of the embodiment of FIG. 8.

Sheet 5 may be coupled to tension member 3 in a variety of methods. A most simple method may pertain to simple folding of sheet 5 about tension member 3. Such a fold also allows easy removal of sheet 5 from tension member 3 so that tension member 3 may remain attached to implement 1 for further use while a new sheet 5 replaces the formerly removed sheet 5. A permanent thermal welding of sheet 5 to the tension member 3 or adherence of sheet 5 to tension member 3 will usually require removal of tension member 3 together with sheet 5 and disposal and replacement of both with a new set of tension member 3 and sheet 5. Sheet 5 may comprise a polymer, preferably a thermoplastic type, which is available in the market, inexpensive and may particularly adapt for the purposes of this invention. In particular, sheet 5 may comprise a self-clinging wrapping nylon sheet, such as used for household food wrapping, so that when sheet 5 is folded about tension member 3, its self-clinging retains it attached to tension member 3. A roll of sheet 5, such as roll 15 shown in FIGS. 10 and 11, may also comprise perforated cutting lines apportioning it into easily-separated detachable portions, so that each portion may be taken out and either removed for installment in implement 1, as in FIG. 1, or—if roll 15 is held by implement 1, removed simultaneously from roll 15 and implement 1 for disposal, as in FIGS. 8–12.

Tension member 3 may comprise a polymer, preferably a thermoplastic type, or a metallic wire, all of which may adapt for a "permanent" tension member 3 that is installed in implement 1 for repeated operations or for a disposable tension member 3 that is replaced after each use.

Referring again to the embodiment of FIGS. 1–5, sheet 5 may also be intersected into portions, each such portion comprises two plies 17 and 19, connected along their edges 21 to from a bag like section 23. Plies 17 and 19 are disjoined from each other to form a separated mouth section 25. One ply of the two plies 17 and 19 in mouth section 25, such as ply 17, may be enfolded about section 23, and the other ply (19) may be coupled to tension member 3.

Implement 1 may comprise grip means 11 in the shape of an arcuate support member 27, across the tips 29 of which, tension member 3 may be stretched. Arcuate support member 27 may also comprise a handle portion 30 coupled thereto, as in FIG. 5, and which may be removable therefrom. Preferably, arcuate support member 27 comprises a flexible elongated bar being substantially straight when in a non-operative mode, as in FIG. 3. Support member 27 may be bent by the user to form a bowed bar, as in FIG. 1 and so retained through its operative mode by means of tension member 3. This may be accomplished by bowing support member 27 while tension member 3 is being attached to tips 29 when tension member 3 is loose. When support member 27 is relaxed, tension member 3 stretches to holds support member 27 in a slightly reduced bowed configuration (FIG. 1).

Figure 6:
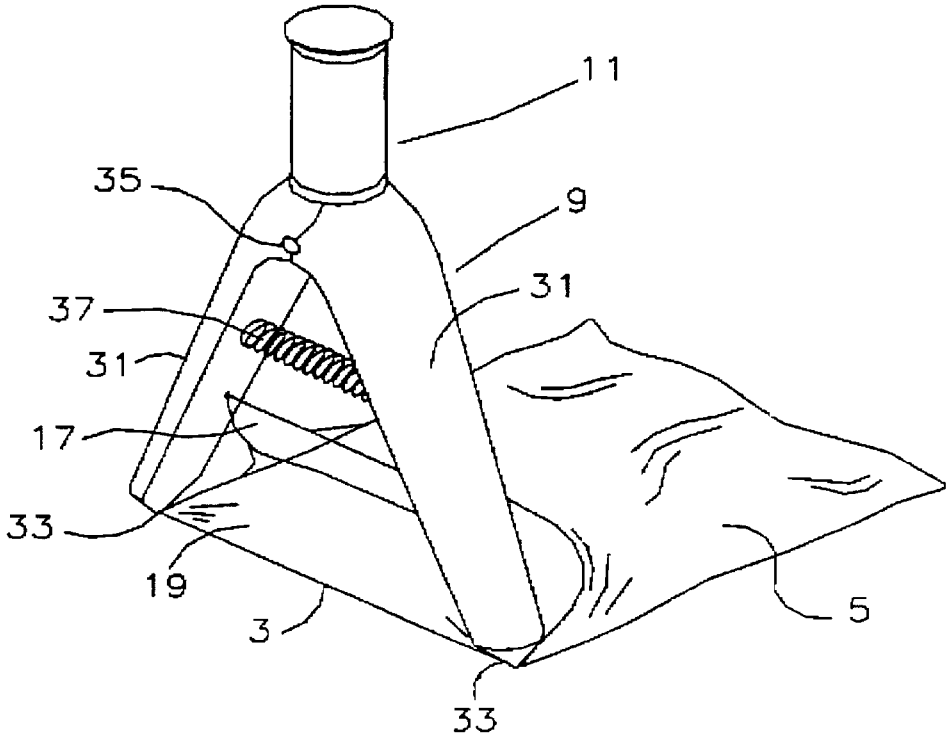
FIG. 6 is a perspective view of another embodiment constructed and operative in accordance with the invention, in its operational configuration.
Figure 7:
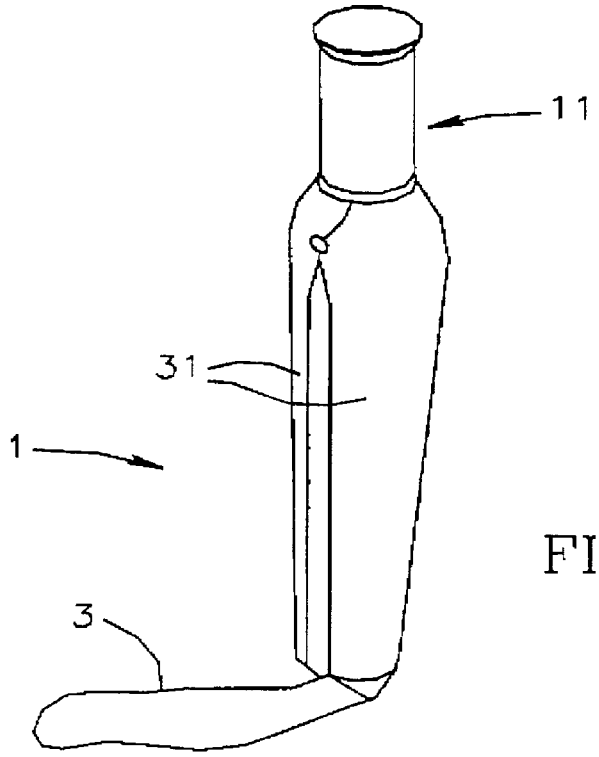
FIG. 7 is a schematic view of the embodiment of FIG. 6 in a collapsed configuration.

Referring now to FIGS. 6 and 7, a variation of the embodiment of FIG. 1 is shown. Implement 1 comprises bipod like casing members 31, across the free ends 33 of which, tension member 3 may be stretched. Casing members 31 are hingedly connected to each other and to the grip means 11, at hinge 35. Grip means 11 may simply comprise an elongated handle that may be locked in its operative position through suitable locking means (not shown). Casing members 31 and elongated handle (means 11) may collapse to be aligned side by side in the stored position, as in FIG. 7. Casing members 31 extend to one direction and elongated handle 11 to the opposite direction when implement 1, is deployed in its operative mode, as in FIG. 6. Casing members 31 further comprise spacing means 35 for keeping them apart when deployed in their operative mode. Such spacing means may include a resilient spring, such as spring 37, or other means such as calibrating threaded nut and bolt mechanism (not shown).

Referring again to FIGS. 1–4 an example of slip means 13 is shown. Slip means 13 comprise two tabs 39 attached to the ends of tension member 3, respectively, and mating notches 41 disposed in arcuate support member 27 and allowing removable respective nesting of tabs 39 thereinto so that notches 41 hold tabs 39 in a snap-fit engagement. Obviously, notches 41 are distanced from each other so as to retain tension member 3 in a stretched configuration when tabs 39 are nested therein. Preferably, each tab 39 comprises a tapered end 43, at which tension member 3 is attached. Tapered end 43 protrudes from arcuate support member 27 toward the surface when the implement is held in an operational mode for picking up and removing pet excrement. Tips 29 of the arcuate support member 27 are preferably rounded or tapered as well. The tapering or rounding of tips 29 and especially tabs 39 facilitate the maneuvering of tension member 3 in close proximity to the ground when implement 1 is moved, allowing the arcuate support member 27 to be held in a continuous variety of inclinations, as the user holding implement 1 finds preferable at the particular moment of moving implement 1.

Figure 8:
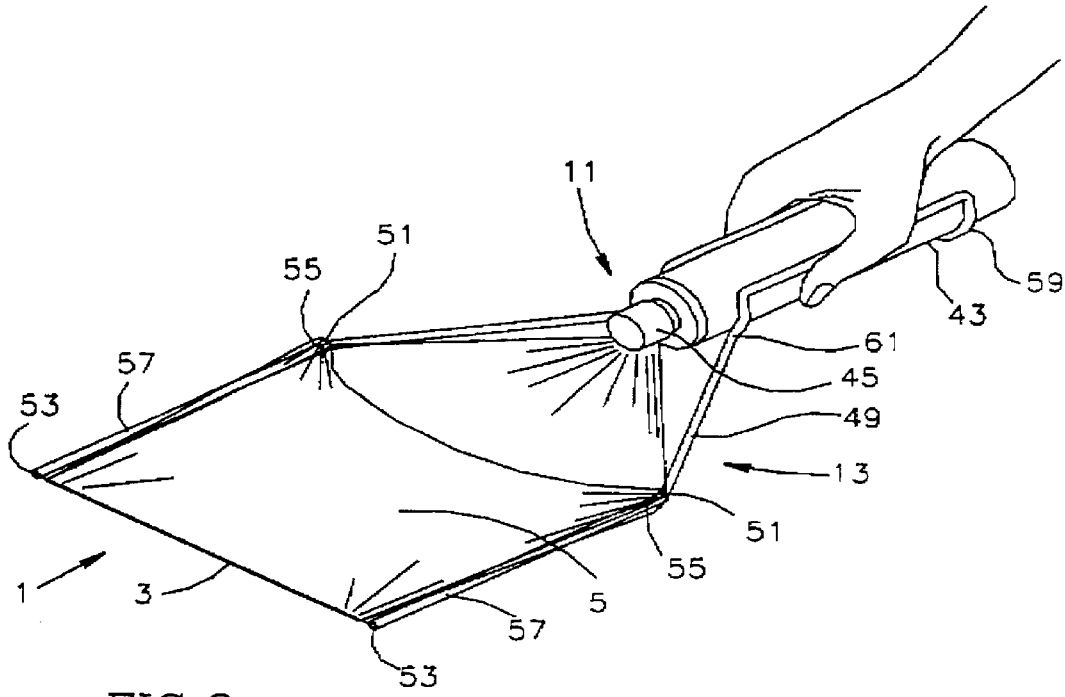
FIG. 8 is a perspective view of a further embodiment constructed and operative in accordance with the invention in its operational configuration featuring a fully spread sheet.
Figure 9:
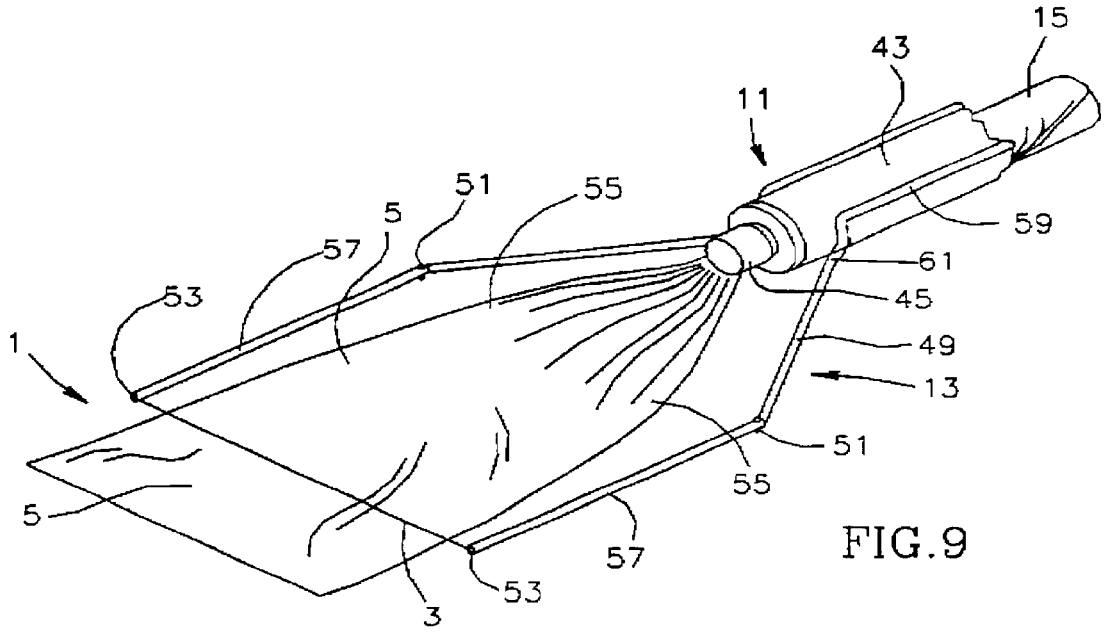
FIG. 9 is a perspective view of the embodiment of FIG. 8 with a partially spread sheet.

In reference to FIGS. 8–12, another embodiment of implement 1 is shown. Grip means 11 comprise an elongated hollow tubular body 43. Tubular body 43 is having an apertured end 45 and is so sized to be comfortably held by a human hand (FIG. 8). Tubular body 43 is adapted for containing a roll 15 of sheet 5 wherein an end 47 of sheet 5 may be unrolled and drawn out through apertured end 45. Slip means 13 comprise two forwardly extending securing arms 57 which are coupled to tubular body 43, by support members 49 and along which sheet 5 may be expanded. The securing arms 57 comprise spikes 51, which spikes 51 are spaced apart at a distance corresponding to the width of sheet 5. Tension member 3 is stretched at edges 53 of securing arms 57 at a distance from spikes 51 adequate for containing pet excrement, wherein a drawn out portion of sheet 5 may be pierced once at its sides 55 by spikes 51, stretched from spikes 51 to tension member 3 and folded about tension member 3 to stretch back toward spikes 51 and pierced again by them to form a two ply extension of sheet 5, stretched between spikes 51 and tension member 3.

Securing arms 57 are distanced from each other at a distance corresponding to the width of sheet 5. Spikes 51 are mounted in registration on securing arms 57, adjacent to apertured end 45 of tubular body 43, and tension member 3 is stretched between the free ends 53 of securing arms 57.

Further preferably, slip means 13 comprise a rigid strap 59 curving around tubular body 43 so as to snugly engage tubular body 43 in a friction tight engagement, and wherein support members 49 are firmly attached to the ends 61 of strap 59.

Optionally, apertured end 45 of tubular body 43 comprises a lid 63 having a threaded sleeve 65 adapted to its screwing in a mating threaded end portion 67 of tubular body 43 or its apertured end 45. Lid 63 may further comprise a centrally apertured extension 69 through which sheet 5 may be passed in a contracted manner, the extension being externally threaded and adapted to its partial or full closure by an internally threaded compatible cap member 71.

Spikes 51 may comprise a pair of cone shaped spikes having their base side 73 mounted on securing arms 57, correspondingly, and a groove 75 cut around each of spikes 51 at a distance from its peak 77. The single pair of spikes 51 may serve for hooking both plies of sheet 5—the upper and the lower, at once. But for further comfort in hooking the lower ply of sheet 5, spikes 51 may comprise another pair of spikes 79, so that one pair (spikes 51) protrudes upwards and the other pair (spikes 79) protrudes downwards.

It will be appreciated by those skilled in the art that although the invention was described above in reference to structural elements, it also inherently discloses a method for picking up and removing pet excrement from a surface. Such a method comprises the steps of providing a flexible sheet 5, coupling sheet 5 to a stretched tension member 3 so as to form an edge 7 of sheet 5 led by tension member string 3, moving tension member 3 with sheet 5 coupled thereto toward the excrement to be picked up, while keeping tension member 3 in close contact with the surface, slipping sheet 5 between the excrement and the surface through moving tension member string 3 between the pet excrement and the surface, so as to isolate the excrement from the surface with sheet 5 in between, wrapping the excrement by sheet 5, and removing sheet 5, wrapping the excrement and disposing thereof.

Figure 12:
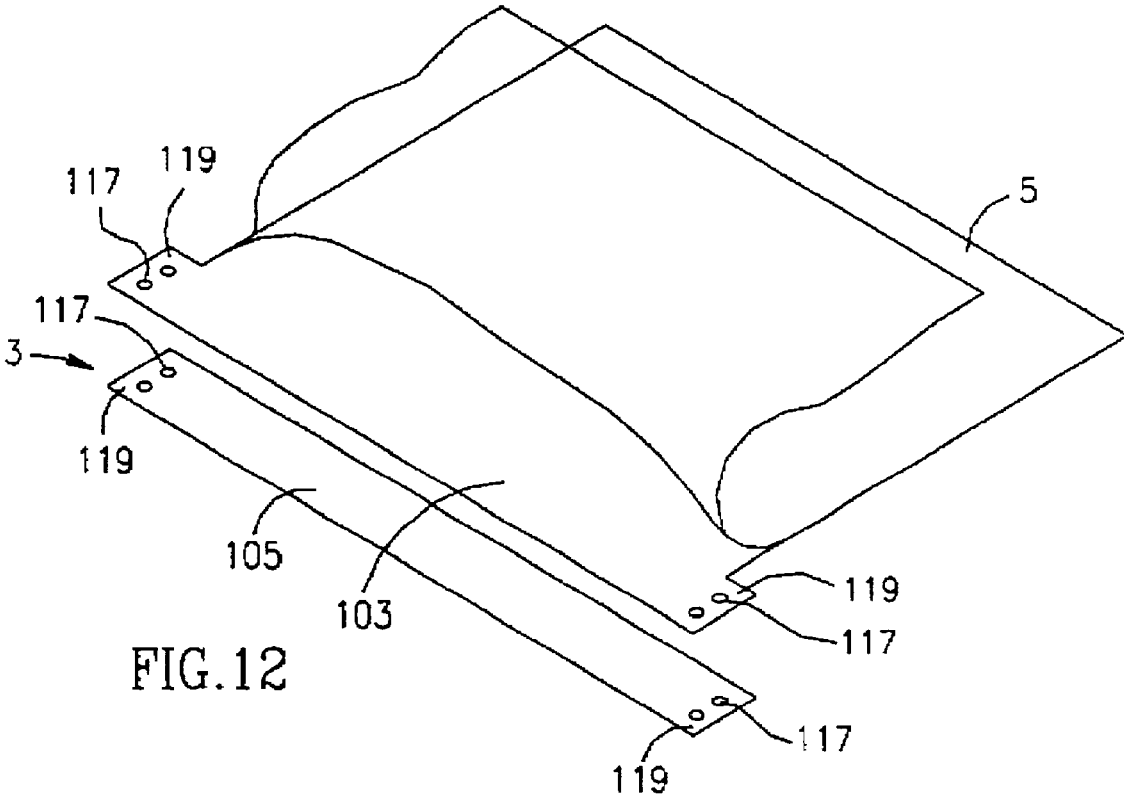
FIG. 12 is a view of a further two ply sheet that may be used in conjunction with the invention.
Figure 13:
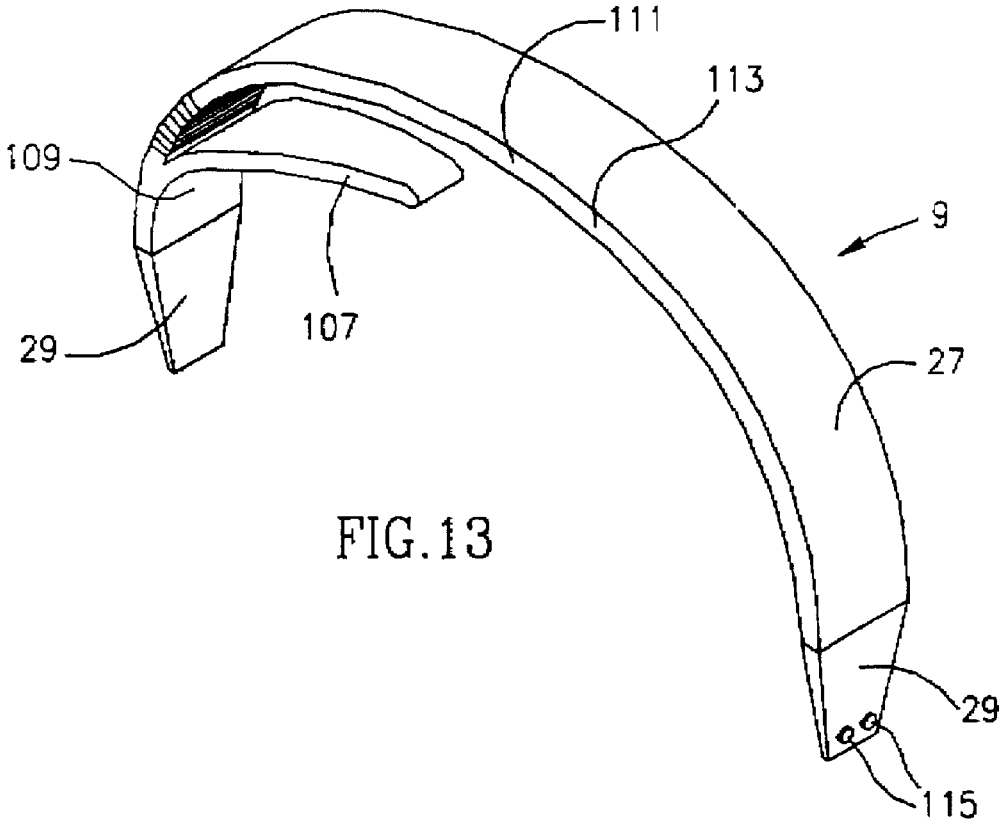
FIG. 13 is a perspective view of a further embodiment constructed and operative in accordance with the invention, designed for use with the sheet shown in FIG. 12.

In reference to FIGS. 12 and 13, a further embodiment, resembling that of FIG. 1, is presented. Tension member 3 comprises an integral leading edge 103 of sheet 5. Leading edge 103 preferably comprises a toughened material that ensures that the edge 103 is comfortably slipped between the excrement and the surface as explained above. Strip 105 comprises a longitudinally non-elastic and transversely flexible material, such that strip 105 can provide a substantially straight leading edge 103, to the sheet 5, while it is stretched by the bar 27. For ease of manufacture, leading edge 103 may comprise a strip 105, and strip 105 may be thermally welded to sheet 5 at the leading edge 103.

Support member 27 is again in the form of an arcuate member that comprises a flexible bowed bar. The bar comprises a contraction handle 107 extending from the inner side portion 109 of the bar 109 parallel to the upper portion 111 of bar 27 toward the intermediate portion 113 of bar 27. Handle 107 being sized for its forcing by at least one finger of the user, gripping bar 27 toward upper portion 111 of bar 27, thereby temporarily contracting the bar by nearing the tips 29 of bar 111 so that the long handle 107 is forced toward bar 27.

Arcuate member 27 comprises at least one laterally protruding hook element, such as hooks 115 mounted at each of tips 29. Tension member 3, namely—leading edge 103 and strip 105 comprise mating openings 117 at their ends 119. Hooks 115 preferably comprise broadened head portion resembling that of a nail or a thumbtack for keeping openings 117 well seized over hooks 115. It will be appreciated that such structure provides for the loose assembling of tension member 3, or leading edge 103, on arcuate member 27, when member 27 is temporarily forced to contract; and provides for the stretching of the assembled tension member 3 when the contraction force ceases to apply thereto.

It will be appreciated by those skilled in the art that the invention is not limited to what has been shown and described hereinabove by way of example only. Rather, the invention is limited solely by the claims which follows.

What is claimed is:

1. An implement for picking up and removing pet excrement from a surface, comprising:

a support member having two securing ends;

a tension member removably stretched at two spaced apart points thereof to said two securing ends; and, a disposable flexible sheet for isolating said pet excrement from said surface by sliding said sheet between the pet excrement and said surface, said sheet being permanently attached to said tension member at a leading edge of said sheet, the sheet and the tension member being removable from said support member, wherein said securing ends provide for close contact of said tension member with said surface while said implement is held by the hand of the user and moved about.

2. An implement as in claim 1, wherein said tension member is thermally welded to said sheet.

3. An implement as in claim 1, wherein said tension member is adhered to said sheet.

4. An implement as in claim 1, wherein said sheet comprises a polymer.

5. An implement as in claim 4, wherein said polymer comprises a thermoplastic material.

6. An implement as in claim 1, wherein said sheet comprises a self-clinging wrapping nylon sheet.

7. An implement as in claim 1, wherein said sheet is apportioned from a roll of sheet, said roll comprises perforated lines apportioning said roll into easily-separable portions of sheet.

8. An implement as in claim 1, wherein said sheet being apportioned into detachable portions, each such portion comprises two plies, a first section of which plies comprises three connected edges to form a bag like section, the plies being disjoined at their second section to form a mouth section, wherein one ply of said two disjoined plies in the mouth section provides for its enfolding about said bag like section, and the other of said two disjoined plies is attached to said tension member.

9. An implement as in claim 1, wherein said support member comprises an arcuate member, across the tips of which said tension member is removably stretched.

10. An implement as in claim 9, wherein said arcuate member comprises a handle portion coupled thereto.

11. An implement as in claim 10, wherein said handle portion is removably coupled to said arcuate member.

12. An implement as in claim 9, wherein said arcuate member comprises a flexible elongated bar being substantially straight when in a non-operative mode, said bar providing for its bending by the user to form a bowed bar and so retained in its operative mode by means of attaching said tension member to the tips of said bowed bar, wherein said arcuate member in its operative mode continuously stretches said tension member when said tension member is attached to said arcuate member.

13. An implement as in claim 9, wherein said arcuate member comprises a flexible bowed bar, said bar comprises a contraction handle extending from the inner side portion of said bar parallel to the upper portion of said bar toward the intermediate portion of said bar, the handle being sized for its forcing by at least one finger of the user gripping said bar toward the upper portion of said bar, thereby temporarily contracting the bar by nearing the tips of said bar so long as said handle is forced toward said bar.

14. An implement as in claim 9, wherein said arcuate member comprises at least one laterally protruding hook element mounted at each of its tips, said tension member comprises mating openings at its ends providing for the loose assembling of said tension member on said arcuate member, when said arcuate member is temporarily forced to contract, said arcuate member stretches said tension member so assembled, when the contraction ceases.

15. An implement as in claim 1, wherein said support member comprises bipod like casing members across the free ends of which said tension member may be stretched, said casing members being hingedly connected to each other and to an elongated handle, said casing members and said elongated handle are collapsible to be aligned side by side in the stored position of said support member, said casing members extend to one direction and said elongated handle to the opposite direction when said support member is deployed in its operative mode, said casing members further comprise spacing means for keeping them apart when deployed in their operative mode.

16. An implement as in claim 1, wherein said tension member comprises two tabs at the ends thereof, said support member comprises mating notches at said securing ends allowing removable snap-fit nesting of said tabs in said notches.

17. An implement as in claim 16, wherein each of said tabs comprises a tapered portion attached to an end of said tension member, said tapered portion protruding downwardly from said support member and touching said surface when said implement is held in an operational position.

18. An implement as in claim 1, wherein said tension member comprises a polymer.

19. An implement as in claim 18, wherein said polymer comprises a thermoplastic material.

20. An implement as in claim 1, wherein said tension member comprises a metallic wire.

21. An implement as in claim 1, wherein said tension member comprises a strip.

22. An implement as in claim 21, wherein said strip comprises a longitudinally non-elastic and transversely flexible material.

23. An implement as in claim 1, wherein said tension member comprises a toughened material.

24. An implement for picking up and removing pet excrement from a surface, comprising:

a disposable flexible sheet for isolating said pet excrement from said surface by sliding said sheet between the pet excrement and said surface, said sheet being removable from said implement;

grip means in the form of an elongated hollow tubular body having an apertured end and being so sized to be comfortably held by a human hand, said tubular body being adapted for containing a roll of said sheet wherein an end of said sheet may be unrolled and drawn out through said apertured end;

a support member comprising two forwardly extending securing arms coupled to said tubular body and along which said sheet may be expanded, said securing arms comprise spikes, which spikes being spaced apart at a distance corresponding to the width of said sheet; and, a tension member stretched between distal ends of said securing arms at a distance from said spikes adequate for containing pet excrement, wherein a drawn out portion of said sheet may be pierced once at its sides by said spikes, stretched from said spikes to said tension member, folded about said tension member, stretched back toward said spikes, and pierced again by said spikes to form a two ply extension of said sheet stretched between said spikes and said tension member, and wherein said securing arms provide for close contact of said tension member with said surface while said implement is held by the hand of the user and moved about.

25. An implement as in claim 24, wherein said support member comprises a rigid strap curving around said tubular body so as to snugly engage said tubular body in a friction tight engagement, and wherein said securing arms are firmly attached to said strap.

26. An implement as in claim 24, wherein said apertured end of said tubular body comprises a lid having a threaded sleeve adapted to its screwing in a mating threaded end portion of said tubular body, said lid further comprises a centrally apertured extension through which said sheet may be passed in a contracted manner, said extension being externally threaded and adapted to its partial or full closure by an internally threaded compatible cap member.

27. An implement as in claim 24, wherein said spikes comprise a pair of cone shaped spikes having their base mounted on said securing arms, correspondingly and a groove is cut around each of said spikes at a distance from its peak.

28. An implement as in claim 24, wherein said spikes comprise two pairs of spikes, wherein one pair protrudes upwards and the other pair protrudes downwards.

29. An implement for picking up and removing pet excrement from a surface, comprising:

a support member having two securing ends;

a tension strip removably stretched at two spaced apart points thereof to said two securing ends; and, a disposable flexible sheet for isolating said pet excrement from said surface by sliding said sheet between the pet excrement and said surface, said sheet attached to said tension strip at leading edge of said sheet, the sheet and the tension strip being removable from said support member, wherein said securing ends provide for close contact of said tension strip with said surface while said implement is held by the hand of the user and moved about.

30. An implement as in claim 29, wherein said tension strip is permanently attached to said sheet.

31. An implement as in claim 29, wherein said tension strip comprises a longitudinally non-elastic and transversely flexible material.

32. An implement as in claim 29, wherein said tension strip comprises a toughened material.

33. A method for picking up and removing pet excrement from a surface, comprising the steps of:

(a) providing a flexible sheet;

(b) permanently coupling said sheet to a stretched tension member so as to form a leading edge of said sheet;

(c) moving said tension member with said sheet coupled thereto toward the excrement to be picked up, while keeping said tension member in close contact with said surface;

(d) slipping said sheet between the excrement and said surface by moving said tension member between the pet excrement and said surface, so as to isolate the excrement from said surface, by said sheet there between;

(e) wrapping the excrement by said sheet; and (f) removing said sheet wrapping the excrement and disposing thereof.

34. A method for picking up and removing pet excrement from a surface, comprising the steps of:

(a) providing a flexible sheet;

(b) coupling said sheet to a stretched tension strip so as to form a leading edge of said sheet;

(c) moving said tension strip with said sheet coupled thereto toward the excrement to be picked up, while keeping said tension strip in close contact with said surface;

(d) slipping said sheet between the excrement and said surface by moving said tension strip between the pet excrement and said surface, so as to isolate the excrement from said surface, by said sheet there between;

(e) wrapping the excrement by said sheet; and (f) removing said sheet wrapping the excrement and disposing thereof.

* * * * *